US007174892B2

(12) United States Patent
Pietrelli

(10) Patent No.: US 7,174,892 B2
(45) Date of Patent: Feb. 13, 2007

(54) REGULATOR FOR UNDERWATER BREATHING DEVICES

(75) Inventor: Nino Pietrelli, Sori (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 10/095,436

(22) Filed: Mar. 13, 2002

(65) Prior Publication Data

US 2002/0134385 A1 Sep. 26, 2002

(30) Foreign Application Priority Data

Mar. 23, 2001 (IT) ..... GE2001A0029

(51) Int. Cl.
*A61M 16/00* (2006.01)
*A62B 7/10* (2006.01)
*A62B 18/10* (2006.01)
*B63C 11/02* (2006.01)

(52) U.S. Cl. ..... 128/204.26; 128/204.18; 128/205.24; 128/201.27; 128/201.28

(58) Field of Classification Search ..... 128/204.26, 128/204.27, 201.27, 201.28, 205.24, 204.18, 128/207.14, 207.16; 137/375, 377, 381, 137/382; 270/724; 114/315; 220/724
See application file for complete search history.

(56) References Cited

U.S. PATENT DOCUMENTS 3,731,534 A * 5/1973 Painley et al. ..... 73/273
3,738,383 A * 6/1973 David ..... 137/381
4,383,964 A * 5/1983 Prus ..... 264/237
4,386,624 A * 6/1983 Christianson ..... 137/102
4,460,089 A * 7/1984 Abbott ..... 206/527
4,510,965 A * 4/1985 Peroux et al. ..... 137/375
4,553,562 A * 11/1985 Nakada ..... 137/375
4,574,797 A * 3/1986 Christianson ..... 128/204.26
4,676,238 A * 6/1987 Wetzel et al. ..... 128/204.26
4,784,129 A 11/1988 Garraffa
5,095,936 A * 3/1992 Briet et al. ..... 137/375
5,145,148 A * 9/1992 Laurent ..... 251/129.14
5,305,741 A * 4/1994 Moles ..... 128/207.14
5,318,018 A * 6/1994 Puma et al. ..... 128/202.11
5,720,280 A * 2/1998 Elstran et al. ..... 128/205.25
6,276,361 B1 * 8/2001 White ..... 128/200.24
6,298,849 B1 * 10/2001 Scholey et al. ..... 128/205.27
6,311,722 B1 * 11/2001 Gounot et al. ..... 137/382

* cited by examiner

*Primary Examiner*—Teena Mitchell
*Assistant Examiner*—Annette Dixon
(74) *Attorney, Agent, or Firm*—Stites & Harbison PLLC; Marvin Petry

(57) ABSTRACT

Regulator for underwater breathing devices including a relatively hard material box-like body having a pipe for the connection with a mouthpiece, at least one air inlet duct and at least one opening on which-it is positioned one air exhaust valve. The regulator box-like body is externally covered by at least one layer of a suitably shaped relatively soft material.

3 Claims, 2 Drawing Sheets

REGULATOR FOR UNDERWATER BREATHING DEVICES

FIELD OF THE INVENTION

The present invention refers to the regulators for underwater breathing devices.

BACKGROUND OF THE INVENTION

As is well-known the body of the regulators for underwater breathing devices includes a box-like member, made generally from a comparatively hard material, provided with a pipe for the connection to a mouthpiece, a duct for the inlet of the air from a source of compressed air, such as diving bottles, and an opening on which is positioned an air exhaust valve.

To the box-like body of the regulator are connected exhaust ducts (or sleeves) made of a material different from the material of the box-like body and whose main task is to channel the air exhausted from the said exhaust valve. In U.S. Pat. No. 4,784,129 a regulator is described in which said exhaust ducts are made of the same material of the box-like body of the regulator and integral with it, so to reduce the costs and the regulator maintenance problems, and to avoid exaust ducts from disconnecting and getting lost during diving. However said box-like body and the integral exhaust ducts are normally made using a relatively hard material, such as fiberglass or the like material, which proves to be discomforting, troublesome and uncomfortable for the diver. Moreover said box-like bodies have standard shapes and colors, then turning out to not be personalizable by the diver.

SUMMARY OF THE INVENTION

The object of the present invention is to avoid the drawbacks of the known regulators by providing a regulator for underwater breathing devices comprising a box-like body made of relatively hard material and having a pipe for the connection with a mouthpiece, at least one air inlet duct and at least one opening on which is positioned one air exhaust valve; said box-like body being externally covered by at least one layer of a relatively soft material suitably shaped so as to leave uncovered the outer end of the mouthpiece pipe, and the outer end of the compressed air inlet duct and to leave open the access to the air exhaust valve.

According to a further aspect of the present invention, the regulator includes a baffle of relatively soft material fastened to the covering layer of the box-like body and comprising exhaust ducts for the air coming out of the said exhaust valve.

Advantageously, the soft material, from which the baffle is made and the material forming the covering of the box-like body of the regulator, will be much more comfortable than the hard material used in the known prior art regulators. Moreover the diver will be able to choose the preferred color and shape for the covering layer of the box-like body of the regulator and for the baffle, said layer and said baffle being applied, through for instance a molding process, after the manufacture of the box-like body.

BRIEF DESCRIPTION OF THE DRAWINGS

Further objects and advantages of the present invention will be better understood from the following description of one preferred embodiment of the invention, to be considered as a non-limitative example and made with reference to the enclosed drawings where.

DESCRIPTION OF THE PREFERRED EMBODIMENT OF THE INVENTION

Figure 1:
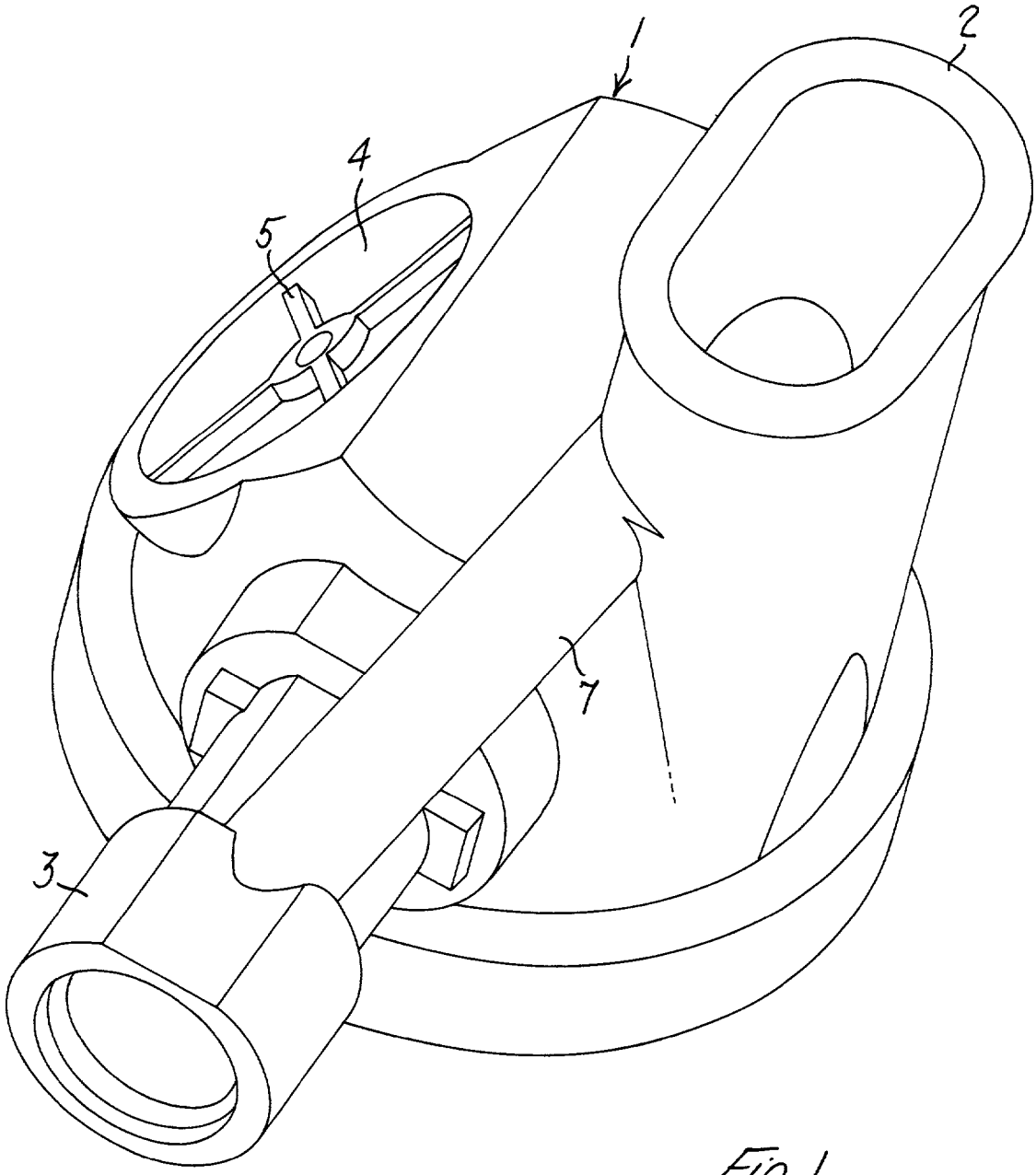
FIG. 1 is a perspective view of a known regulator for underwater breathing devices, without the exhaust duct which normally is mechanically assembled in a subsequent time.

In FIG. 1 a regulator for underwater breathing devices is shown, formed by a box-like body 1 including a pipe 2 for the connection to a mouthpiece (not shown), a duct 3 for the inlet of the air from a source of compressed air, an opening 4 having a support for an exhaust valve 6 (shown in FIG. 2) and a duct 7 for the by-pass of the air from the compressed air inlet duct 3 to the connecting pipe 2 of the mouthpiece.

Figure 2:
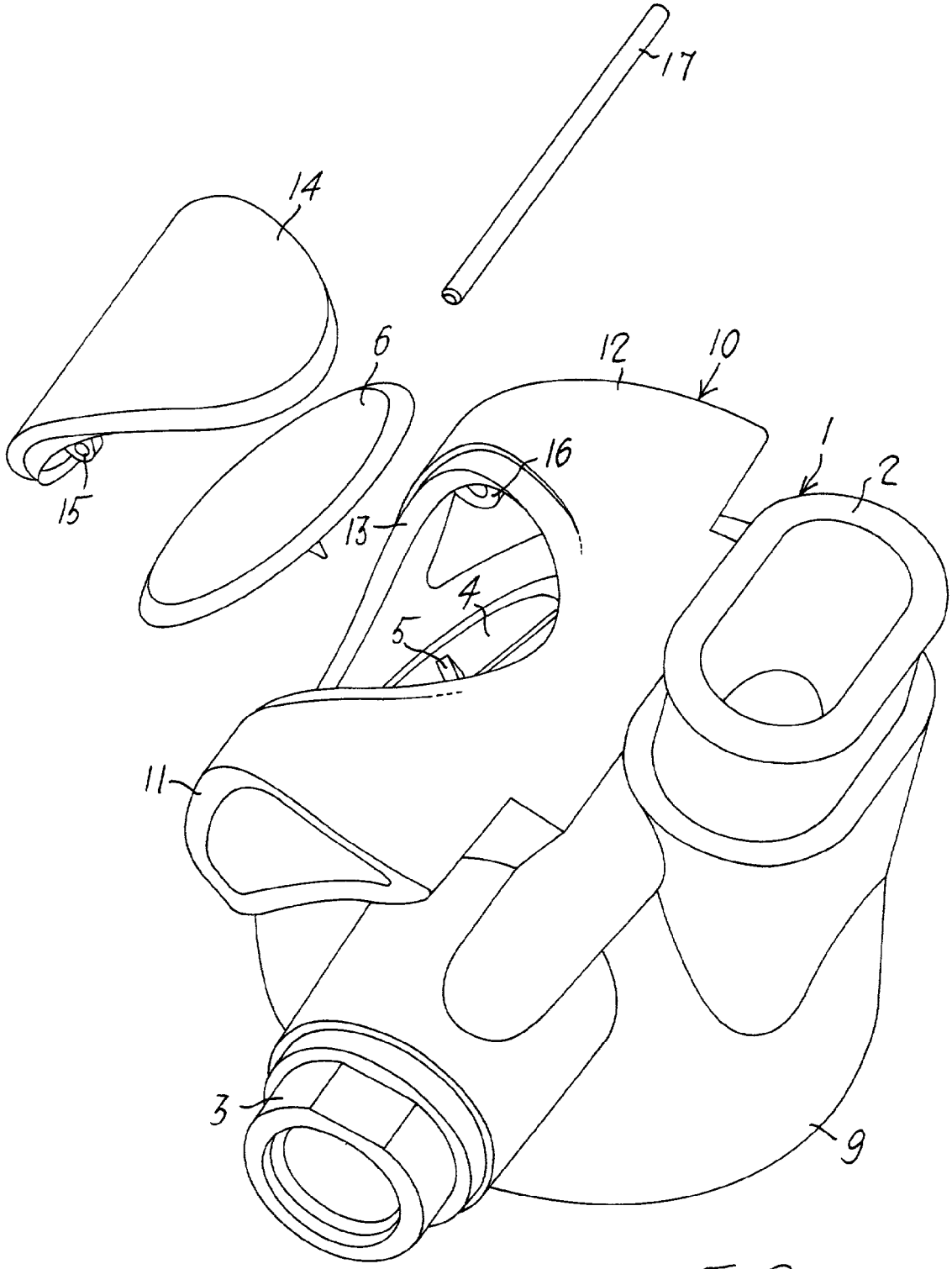
FIG. 2 is a perspective view of a regulator for underwater breathing devices provided with the soft covering according to the present invention.

In FIG. 2 is shown the box-like body 1 to which is applied, through for instance a molding process, a layer 9 of soft material. As can be noticed, the layer 9 is shaped so to leave an end part of the pipe 2 free for connection to a mouthpiece, to leave free the end part of the inlet duct 3 for further elements connecting the compressed air source and finally to leave unchanged the air exhaust opening 4. On this covering layer, on the air exhaust opening 4, a baffle 10 made also of a soft material is over-molded, and is of the same or a different material from the material of the covering layer 9. The baffle 10 includes sideways two air exhaust ducts 11 and 12 and upwards a hole 13 provided with a removable closing cap 14, fit to allow the access and the eventual removal of the exhaust valve 6. On the inner layer of the cap 14 are provided two supporting rings 15 (only one of which is shown) for an arm 17, said rings, when the cover 14 is positioned on the hole 13, aligned with two aligned annular supports 16 (only one of which is shown), each of them located by the side of the edge of said hole 13 and inside the upper surface of the baffle 10. The arm 17 then, to close the baffle 10, is inserted into the four holes of the rings 15 and of the annular supports 16.

Said baffle 10 can be, as mentioned before, made of the same or different soft material than the material of the covering layer 9 and moreover it can be changed in color, length and shape of the exhaust ducts 11 and 12 and otherwise as the diver using the present regulator prefers. When the material of the baffle 10 is the same of the layer 9, the baffle 10 will be fastened to the layer 9 at the same time as the application of said layer 9 to the regulator; When the baffle 10 is made using a different material, it can be fastened to said layer 9 through suitable adhesive materials or otherwise.

I claim:

1. A regulator for underwater breathing devices, said regulator comprising:

a box body made of relatively hard material and having a pipe for connection with a mouthpiece, at least one air inlet duct and at least on exhaust duct on which is positioned an air exhaust valve;

a covering layer of a relatively soft material over-molded onto the box body thereby forming an external cover, said covering layer not covering openings of the air inlet duct, the exhaust duct and the pipe, and a baffle element made of the same material as the covering layer and including ducts for the exhaust of the air coming out of said exhaust valve, said baffle including two exhaust ducts positioned sideways as to said exhaust valve, said baffle being provided with an upper surface positioned in front of said valve and provided with at least one hole closed by a removable cap, said cap including on its inner surface at least one supporting ring which, in the positioning of said cap onto the hole formed on the baffle, is aligned with at least two annular supports, each one formed on the inner surface of said baffle and near the side edge of said hole, a removable arm passing through said annular supports and said ring.

2. The regulator according to claim 1, in which said baffle is over-molded to said covering layer and is of the same material as the covering layer.

3. A regulator for underwater breathing devices including a box body made of relatively hard material and having a pipe for connection with a mouthpiece, at least one air inlet duct and at least one opening on which is positioned an air exhaust valve, said box body being externally covered by a covering layer of a suitably shaped relatively soft material, conforming to the shape of the box body, a baffle made of the same material as the covering layer and including ducts for the exhaust of the air coming out of said exhaust valve, said baffle including two exhaust ducts positioned sideways with respect to said exhaust valve, said baffle being provided with an upper surface positioned in front of said valve and provided with at least one hole closed by a removable cap, said cap including on its inner surface, at least one supporting ring which, in the positioning of said cap onto the hole formed on the baffle, is aligned with at least two annular supports, each one formed on the inner surface of said baffle and near the side edge of said hole, being said annular supports and said ring passed through by a removable arm.

* * * * *